United States Patent [19]

Clark

[11] 3,945,388

[45] Mar. 23, 1976

[54] APPARATUS FOR COUNTERFLOW RINSING OF WORKPIECES

[75] Inventor: Chester G. Clark, Grosse Pointe Woods, Mich.

[73] Assignee: Oxy Metal Industries Corporation, Warren, Mich.

[22] Filed: July 29, 1974

[21] Appl. No.: 492,620

[52] U.S. Cl. ..... 134/57 R; 134/60; 134/101; 134/103; 134/148

[51] Int. Cl.[2] ..... B08B 3/02

[58] Field of Search ..... 134/43, 57 R, 60, 95, 99, 134/100, 101, 103, 148, 153

[56] References Cited

UNITED STATES PATENTS

| | | | |
|---|---|---|---|
| 1,045,079 | 11/1912 | Prunier et al. | 134/60 UX |
| 2,471,506 | 5/1949 | Wiswall | 134/103 X |
| 2,561,631 | 7/1951 | Negri | 134/95 X |
| 2,718,714 | 9/1955 | Bocchino | 134/99 X |
| 2,721,562 | 10/1955 | Irvine | 134/60 |
| 3,134,070 | 5/1964 | Meyer | 134/57 R X |
| 3,674,673 | 7/1972 | Jessup | 259/89 X |
| 3,849,197 | 11/1974 | Sorrentino | 134/60 X |
| 3,856,572 | 12/1974 | Hildebrand | 134/103 X |

FOREIGN PATENTS OR APPLICATIONS

| | | | |
|---|---|---|---|
| 1,386,199 | 12/1964 | France | 134/60 |

*Primary Examiner*—Robert L. Bleutge
*Attorney, Agent, or Firm*—Harness, Dickey & Pierce

[57] ABSTRACT

An apparatus for effecting a counterflow liquid treatment of workpieces and particularly an aqueous rinsing of workpieces during an electrochemical treating sequence, such as, for example, an electroplating cycle or the like. The workpieces are subjected to a sequentially-phased treatment with a plurality of solutions while disposed at a treating station, and the individual treating liquids are collected and returned to their respective reservoirs, and the individual reservoirs are counterflowed in a direction opposite to the order of application of liquids to the workpieces.

13 Claims, 6 Drawing Figures

APPARATUS FOR COUNTERFLOW RINSING OF WORKPIECES

BACKGROUND OF THE INVENTION

The present invention is particularly applicable for the liquid treatment of workpieces at one station of a multiple-station treating cycle, such as a chemical, electrochemical and electroplating processing cycle, for example. It is conventional in treating processes of the foregoing type to subject the workpieces to various preliminary cleaning and pretreatments prior to the prescribed chemical treatment, such as electroplating, followed thereafter by one or more post-treatments. It is generally necessary to subject the workpieces to a plurality of aqueous rinse treatments between the pretreatment, electroplating and post-treatment phases to minimize contamination of the several treating solutions by residual treating solutions carried-over from the preceding treating station.

It is usually preferred to subject the workpieces to at least two and preferably three or more individual water rinse treatments in a counterflow manner to reduce the quantity of residual treating solution on the workpiece to a level at which only a small degree of carry-over to adjacent treating stations occurs. It will be appreciated that such a plural rinse treatment in accordance with prior art practices has necessitated an individual treating station for each rinse solution, substantially increasing the length of the processing line and the amount of plant space required for a desired production capacity. It is also conventional in accordance with prior art processes to counterflow the rinse solutions from one rinse tank or reservoir to the next reservoir in a direction of progressively increasing rinse solution contamination. Fresh make-up water is added to the tank having the lowest degree of contamination and the effluent from the rinse tank having the highest degree of contamination is directed to a waste disposal treatment system. Systems of the foregoing type have been found to result in relatively high hydraulic loadings on liquid waste disposal systems, requiring the use of large amounts of chemical reagents and/or energy to effect a concentration and/or incineration thereof, detracting from the efficiency and economics of the process.

The foregoing problems are particularly pronounced during the bulk processing of relatively small workpieces which usually are placed within a barrel of other porous container and are conveyed through the individual treating stations in a prescribed processing sequence. The immersion of such bulk treating barrels in the rinse tanks filled with rinse solutions causes a surge which frequently results in an excessive degree of solution counterflow and fluctuations in composition, and also imposes a large and erratic hydraulic load on the waste disposal system.

The apparatus of the present invention overcomes the problems and disadvantages associated with liquid treating systems of the types heretofore known, providing for a substantial reduction in space requirements for a given production capacity, a more effective liquid treatment of workpieces and a lower rate and more uniform counterflow of the individual treating solutions, substantially reducing the hydraulic load imposed on waste disposal systems.

SUMMARY OF THE INVENTION

The benefits and advantages of the present invention in accordance with the apparatus aspects thereof are achieved by a framework positioned at a treating station and constructed so as to receive and support workpieces during a liquid treatment thereof. A nozzle arrangement is provided for applying a plurality of treating liquids to the surfaces of the work carrier and workpieces thereon when positioned at the treating station. A plurality of reservoirs are associated with the treating station, each containing an individual liquid treating solution and each reservoir having associated therewith supply means for sequentially supplying each liquid to the nozzle system for a prescribed time period. The framework further includes a three-dimensional enclosure defining a collector for intercepting and recovering the liquid applied to the workpieces, which is provided with a drainage system for returning the individual recovered liquid solutions to the respective reservoir for subsequent reuse. The reservoir containing the last-applied treating liquid naving the lowest degree of contamination is provided with an inlet for introducing fresh make-up liquid to the reservoir, while the reservoir containing the first-applied treating liquid having the highest degree of contamination is provided with an outlet for discharging a portion of its treating liquid to a waste disposal system or the like. The individual reservoirs are interconnected to provide for a counterflow of liquid solution from one reservoir to the next reservoir in an ordered sequence opposite to the order of application of the treating solutions to the workpieces.

In accordance with a specific embodiment of the present invention, the apparatus is employed for the aqueous rinsing of workpieces and incorporates sensing means for sensing the level of contamination of the reservoir containing the rinse solution having the lowest degree of contamination and for controlling the addition of fresh make-up water thereto in order to maintain the level of contamination below a preselected maximum level.

Additional benefits and advantages of the present invention will become apparent upon a reading of the description of the preferred embodiments taken in conjunction with the accompanying drawings.

DESCRIPTION OF THE PREFERRED EMBODIMENTS

Figure 1:
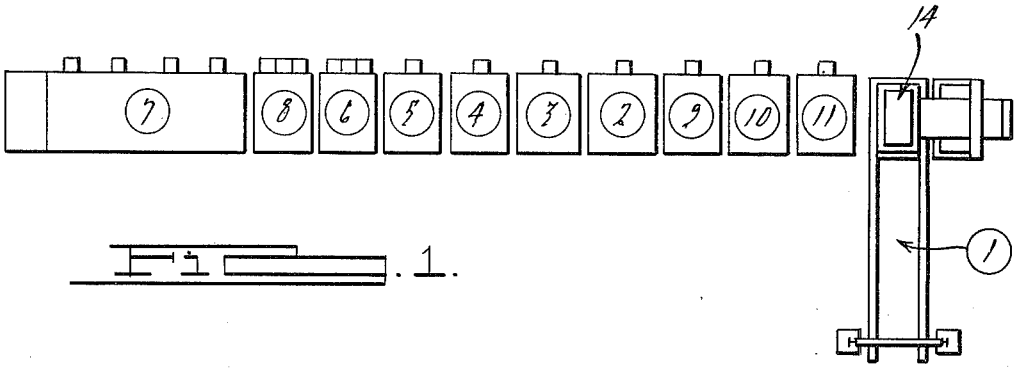
FIG. 1 is a schematic plan view of a typical process arrangement incorporating a plural liquid treating apparatus constructed in accordance with the present invention.

Referring now in detail to the drawings, a typical processing arrangement is illustrated in FIG. 1 comprising a plurality of treating stations including two stations provided with a counterflow liquid treatment apparatus constructed in accordance with the preferred embodiments of the present invention. The arrangement illustrated is particularly applicable for the bulk processing of small workpieces, such as washers, small metal stampings, screws, nuts, bolts or the like, in which the workpieces are carried within a treating barrel which is automatically or manually transferred through a sequentially-phased process cycle. In accordance with the particular arrangement illustrated in FIG. 1, work carriers such as a treating barrel 14 are loaded at a load-unload station indicated at 1, whereafter the loaded work carrier is automatically transferred through the following treating stations: a soak-cleaning operation at station 2; an electro-cleaning operation at station 3; a cold water rinsing step at station 4; an acid treatment at station 5; a plural cold water counterflow rinse treatment at station 6; an electroplating operation in a multiple-station treating tank indicated at 7; a cold water plural counterflow rinse treatment at station 8; a chromate treatment at station 9; a cold water rinse treatment at station 10; a hot water rinse treatment at station 11, whereafter the treating barrel 14 is again returned to the load-unload station in which the treated workpieces are removed therefrom and the treating barrel is filled with a fresh load of parts for processing. The plural counterflow water rinse treatments performed at stations 6 and 8 embody the apparatus features and are performed in accordance with the process aspects of the present invention in a manner subsequently to be described in greater detail. It will be appreciated that alternative processing cycles can readily incorporate the features of the present invention as well as variations, modifications and changes thereof to provide from optimum processing efficiency and without departing from the spirit of the invention as herein described and as set forth in the subjoined claims.

Figure 2:
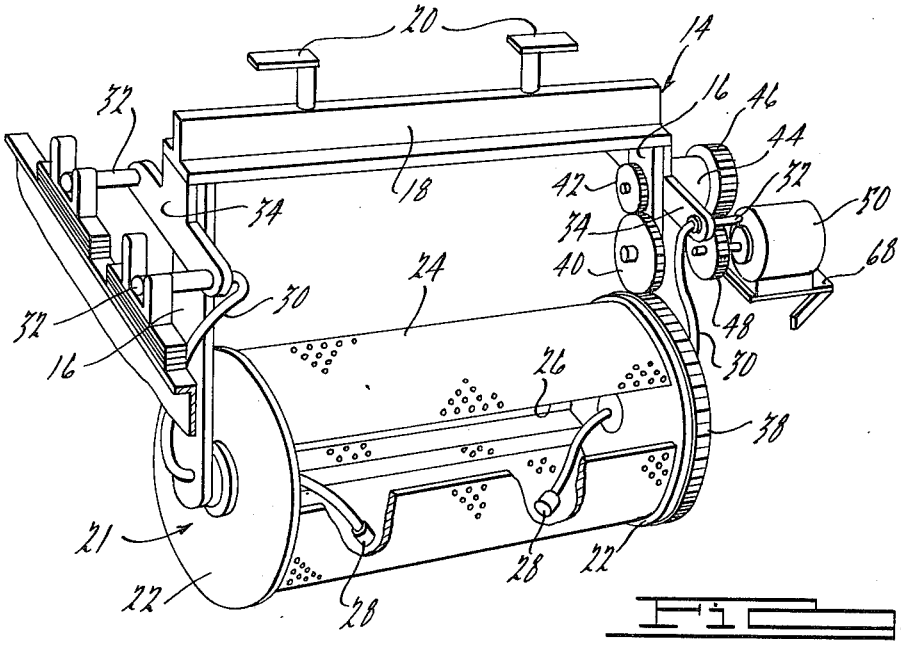
FIG. 2 is a perspective view, with sections thereof broken away for the purposes of clarity, showing a typical work carrier treating barrel for transporting or conveying bulk quantities of workpieces through a liquid treating cycle.

The work carrier 14 as shown in FIG. 2 is of the general type described in U.S. Pat. No. 3,674,673, which is assigned to the same assignee as the present invention. While work carriers of the foregoing types are particularly efficient in the bulk processing of small workpieces, the benefits of the present invention can also be obtained employing alternative work carrier constructions including rotatable treating barrels of a hexagonal cross sectional configuration, oblique treating barrels of the general type shown and described in U.S. Pat. No. 2,148,552, as well as work carrier devices or fixtures on which a plurality of workpieces are individually mounted and retained during their conveyance through the several treating stations. In any event, the work carrier 14, as shown, is of the horizontal oscillating barrel type and comprises a generally inverted U-shaped framework including a pair of upright side members or legs 16 connected at their upper ends to a substantially horizontal cross member 18, to the upper surface of which a pair of L-shaped lift members 20 are affixed, which are adapted to coact with suitable engaging means on an automatic transfer apparatus for lifting and lowering the work carrier and for conveying the carrier from one station to the next adjacent station during a processing cycle. The barrel portion 21 of the work carrier is defined by a pair of substantially circular end members 22 and a foraminous or perforate body member or panel 24, which extends between the two end members and in combination define a substantially cylindrical treating zone in which bulk quantities of workpieces are adapted to be disposed during a treating cycle. The body panel 24 is provided with an elongated slot-like opening 26 extending longitudinally thereof between the end members for providing access to the interior of the treating barrel 21 and the barrel assembly itself is rotatably supported on suitable shafts mounted on the lower end portion of the side legs 16 to enable an oscillation or rotation of the barrel about its longitudinal axis.

As shown in FIG. 2, a pair of dangle electrodes 28 extend inwardly from the central portion of each end member 22 which are adapted to be electrically connected to a buss bar at those stations at which an electroplating or an electrochemical treatment is to be performed on the workpieces. An electrical cable 30, such as shown in FIG. 2, is connected to a supporting lug 32 projecting outwardly of a cross member 34 affixed to the upper portion of each of the legs 16 and wherein the lug 32 is adapted to be seated in electrical contact with a saddle 36 so as to provide the necessary current for an electroplating or electrocleaning treatment at selected work stations.

A rotation and oscillation of the treating barrel while immersed in a treating solution is achieved by means of a gear 38 secured to one face of an end member 22, which in turn is disposed in meshing relationship with an idler gear 40 and a drive gear 42 secured on a shaft coupled through an overrunning clutch assembly 44 to a driven gear 46. In accordance with the arrangement illustrated in FIGS. 2–5, when the work carrier is disposed at a treating station with the supporting lugs 32 in appropriate aligned and seated engagement within the saddles 36, the driven gear 46 is positioned in meshing relationship with a drive gear 48 drivingly coupled to a reversible electric motor 50 which is energizable in accordance with a control cycle embodied in the control system of the processing apparatus. For the purposes of the present invention, the electric drive motor 50 is operated at the plural counterflow rinse stations 6 and 8 in a manner so as to orient the barrel opening 26 with respect to nozzles for applying rinse solutions to the workpieces within the barrel and for subsequently oscillating the barrel through a prescribed angularity for a prescribed time period to effect a rinsing of the treating barrel itself and to facilitate a tumbling and drainage of the workpieces between rinse cycles and preparatory to transfer to the next treating station.

Figure 3:
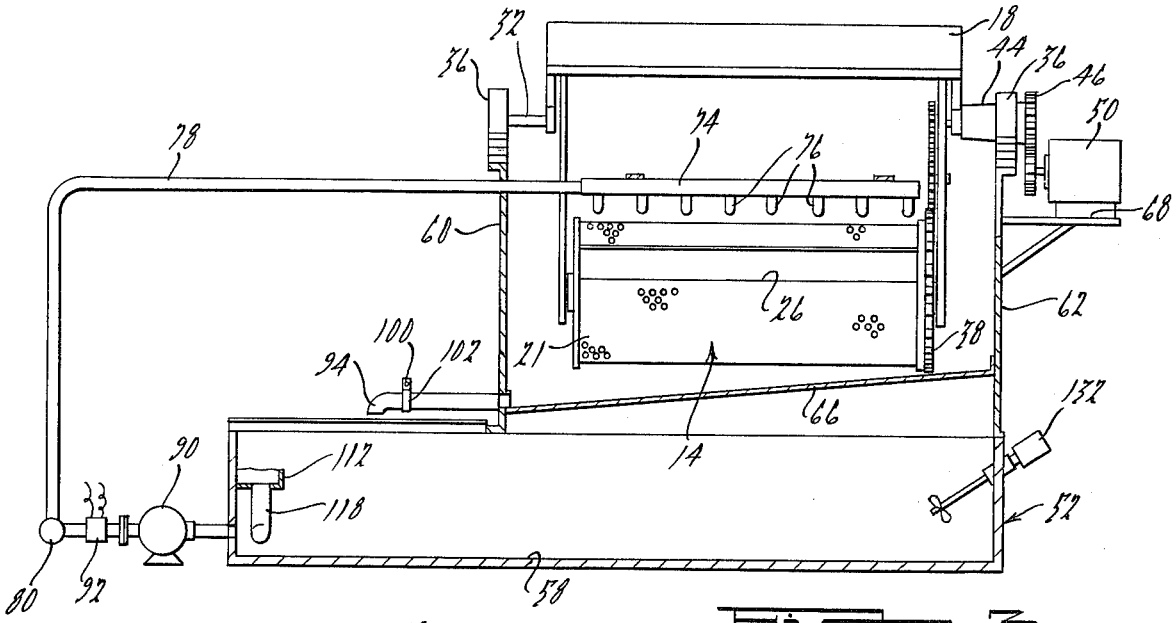
FIG. 3 is an enlarged side elevational view, partly in section, of the treating apparatus comprising the present invention and showing a treating barrel positioned thereat preparatory to a liquid treatment.
Figure 4:
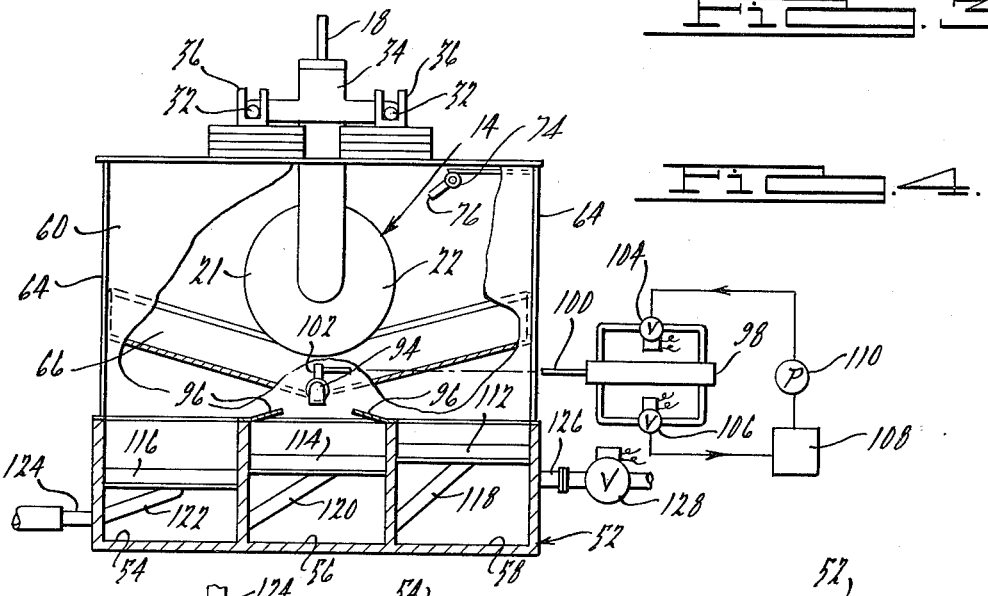
FIG. 4 is a transverse vertical sectional view of the apparatus shown in FIG. 3 and taken substantially along the line 4—4 thereof.
Figure 5:
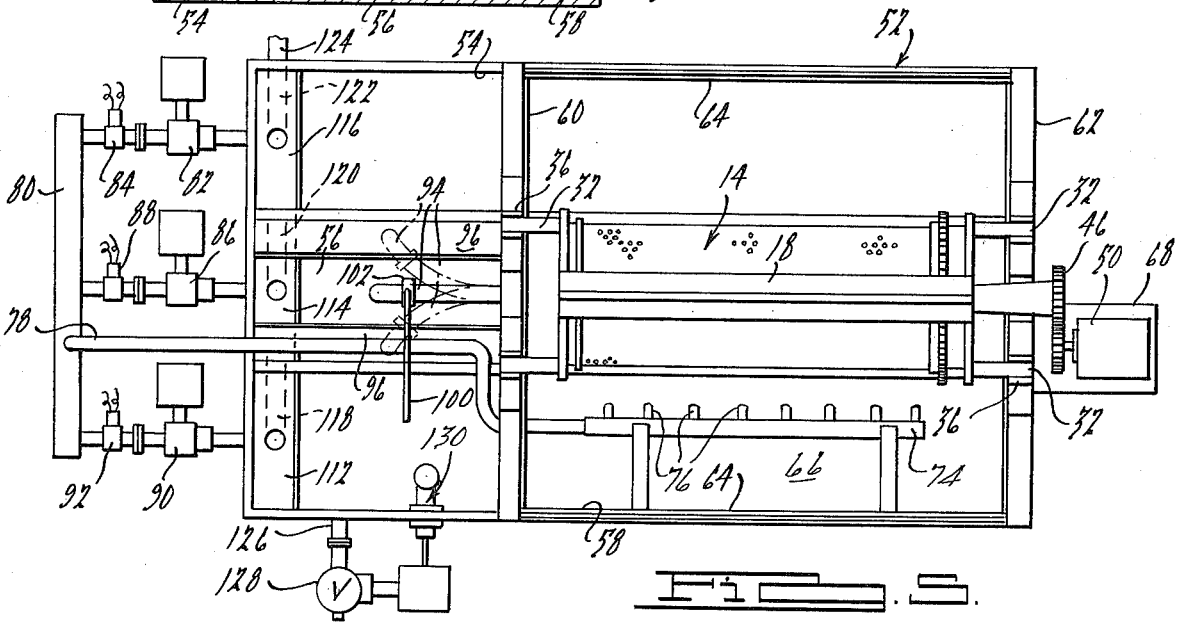
FIG. 5 is a plan view of the apparatus shown in FIGS. 3 and 4.

Referring now in detail to FIGS. 3–5 of the drawings, a liquid treatment apparatus is shown of the type suitable for use at stations 6 and 8 of the process shown in FIG. 1. The apparatus illustrated is specifically adapted for applying three individual rinse solutions in sequentially-phased stepwise manner to the workpieces within the interior of the treating barrel commencing with a rinse solution having the highest degree of contamination, followed with a rinse solution of lesser contamination, and culminating with the use of a rinse solution of the least degree of contamination as controlled by the continuous or intermittent introduction of fresh water to maintain its contamination below a predetermined maximum level. It will be readily appreciated that the apparatus shown in FIGS. 3–5 can be adapted to apply only two rinse solutions as well as to as many as four or more rinse solutions in a counterflowed sequential manner as well as for applying treating solutions other than rinse solutions in the desired counterflowed treating cycle. In accordance with the embodiment shown in FIGS. 3–5, the treating apparatus comprises a framework including a base 52 which is subdivided into three tanks or reservoirs indicated at 54, 56 and 58, respectively. A three-dimensional enclosure is mounted on the base 52 including a pair of spaced side members 60, 62 and a pair of spaced end members 64 connected at their lower end portions to a V-shaped angularly-inclined base or baffle 66, defining therebetween a receptacle or collection chamber within which the lower portion of the work carrier, including the barrel and workpieces, is adapted to be positioned while at the plural rinse station. A pair of the saddles 36 are mounted in appropriate transverse spaced relationship on the upper edge of the side member 60, while a similar pair of saddles 36 are mounted on the upper edge of the side member 62 for receiving the supporting lugs 32 and retaining the work carrier in appropriate alignment at the treating station. A platform 68 is affixed to the outer side of the side member 62 on which the barrel drive mechanism, including the reversible electric motor 50, is mounted in aligned relationship relative to the saddles 36 to assure meshing engagement between the drive gear 48 and the driven gear 46.

Each tank or receptacle 54, 56, 58 contains a separate treating liquid such as an aqueous rinse solution in the specific embodiment illustrated in FIGS. 3–5. The rinse solutions are applied to the treating barrel and to the workpieces therein a stepwise manner through a nozzle header 74 supported by the side members 60, 62 and incorporating a plurality of nozzles or spray heads 76 at spaced intervals therealong which are oriented to discharge the rinse solutions into the interior of the barrel and in contact with the workpieces therein through the opening 26 in the barrel. Selected ones of the nozzles are oriented to direct rinse solution against the surfaces of the treating barrel and supporting framework to effect a removal of contaminating solutions and deposits from the work carrier as well.

The nozzle header 74 is connected by means of a supply conduit 78 to a header 80 which in turn is connected to a pump and valve system associated with each individual tank. As shown in FIGS. 3 and 5, tank 54 is connected to a remotely actuatable motor driven pump assembly 82 having its inlet end connected to the reservoir or tank 54 and its outlet end through a solenoid valve 84 to the header 80. Similarly, the tank 56 is connected through pump assembly 86 and solenoid valve 88 to the header, while tank 58 is connected by means of pump assembly 90 and solenoid valve assembly 92 to the supply header 80. Each pump assembly and its associated solenoid valve assembly is energized and actuated in appropriate timed sequence in accordance with suitable timing devices of the types well known in the art incorporated in the control circuit of the automatic conveying apparatus or a separate control circuit associated with the rinse apparatus and interlocked with the operating cycle of the conveying machine. The operation of each pump assembly is also coordinated with the energization of the reversible motor 50 of the barrel drive mechanism to appropriately position the opening 26 in the barrel in alignment with the nozzles to receive the rinse solution, which is accomplished in accordance with a stop and overrunning clutch mechanism as more fully described in U.S. Pat. No. 3,674,673, the substance of which is incorporated herein by reference. In accordance with a preferred operating sequence, a deenergization of the operation of each pump assembly and a closing of its associated solenoid valve is performed in a manner so as to allow for a predetermined drain period, during which time the treating barrel is oscillated by the barrel drive mechanism to enhance a drainage of any entrapped solution in the workpieces therein. The tumbling of the workpieces within the treating barrel as a result of the oscillation of the barrel is particularly beneficial when processing cup-shaped workpieces which tend to entrap relatively large quantities of liquids.

As will be noted in FIGS. 3–5, the generally V-shaped angularly-inclined disposition of the base or baffle 66 promotes drainage of the rinse liquid discharged against and into the barrel centrally toward the side member 60 which is provided with an outlet for receiving the drained solution and for returning the recovered solution back to the respective tank. The outlet preferably is provided with a swivel or flexible spout 94 which is adapted to be positioned so as to discharge the solution recovered in the collection chamber at a discharge location above the respective tank 54, 56 or 58. A pair of angularly disposed deflector baffles 96 are secured to the upper ends of the walls defining the central tank 56 and are inclined so as to promote drainage of solution toward tanks 54 and 58, respectively, when the flexible spout 94 is disposed in the positions shown in phantom in FIG. 5.

A deflection of the flexible spout from a central or neutral position above the central tank 56 to and from a position for discharge into the tank 54 or the tank 58, as indicated in phantom in FIG. 5, is achieved by a double-acting fluid-actuated cylinder 98 as shown in FIG. 4 having the end of its piston rod 100 secured by means of a bracket 102 to the outer end portion of the flexible spout. The positioning of the flexible spout by the cylinder is accomplished in timed sequence with respect to the operation of the individual pump assemblies and is conveniently achieved by a remotely actuatable solenoid valve 104 which is operable to selectively direct fluid under pressure into either the rod end or blank end of the cylinder and a solenoid drain valve 106 which operates in unison with the solenoid valve 104 for draining and returning fluid back to the reservoir 108 which is connected to the inlet side of a pump 110. The central or neutral position of the cylinder and the flexible spout in which it is disposed above the open top of central tank 56 is accomplished by suitable biasing means, such as springs, which are operative in the absence of fluid pressure to balance the piston in an intermediate position. Accordingly, when fluid pressure is admitted into the blank end of the cylinder, the rod and the flexible spout connected thereto is positioned above the tank 54, and conversely, when fluid pressure is admitted into the rod end portion of the cylinder, the flexible spout is retracted to a position above the tank 58.

The level of rinse solution in each tank is controlled at a predetermined level by means of an overflow weir which, in the embodiment shown, is of a trough-shaped configuration. Tank 58, for example, is provided with a weir 112, which is disposed at a level above the weir 114 in tank 56, which in turn is disposed at a level above a weir 116 in tank 54. In accordance with this arrangement, the level of solution in tank 58 is automatically maintained above that of tank 56, which in turn is maintained at a level above that of tank 54, providing a pressure gradient for counterflowing rinse solution from tank 58 to tank 56 and from tank 56 to tank 54. The weir 112 is connected at its lower end portion to a transfer conduit 118 for transferring the overflowed rinse solution in tank 58 to the base of tank 56 and in admixture with the rinse solution therein. Similarly, the overflow weir 114 is connected by means of a diagonal transfer conduit 120 disposed in communication with the base of tank 54 for transferring overflowed rinse solution from tank 56 into tank 54 and in admixture with the treating solution therein. The overflow from the weir 116 in tank 54 is connected by means of a drain conduit 122 to an outlet or discharge conduit 124, which is connected to a suitable waste disposal and/or treatment and recovery system, as the case may be, before it is discharged to waste.

In the specific embodiment shown, fresh make-up water is supplied by means of an inlet conduit 126 provided with a solenoid-actuated flow control valve 128 for controlling the quantity and timing of addition of such make-up water. In the use of the apparatus for performing a multiple counterflowed rinse treatment of workpieces, it is usually preferred to control the level of contamination of the final rinse solution, although control of contamination of any of the individual rinse solutions by adding make-up fresh water on a continuous or intermittent basis is also satisfactory. This can be accomplished by installing a sensing device of any of the types well known in the art in tank 58 for sensing the condition of the rinse solution thereon or by controlling the quantity of fresh make-up water added on a calculated basis supplemented by periodic analyses of the individual solutions. When rinsing workpieces having water-soluble contaminating salts on the surfaces thereof, it is usually preferred to employ a conductivity sensing device, such as diagrammatically indicated at 130 in FIG. 5, for sensing the electrical conductivity of the rinse solution which varies directly in relationship to the concentration of soluble contaminating ions present. By preselecting a maximum conductivity condition as a maximum level of contamination, the sensing device through the central control circuit is operative to energize the flow control valve 128 to admit fresh make-up water into the tank 58 and in admixture with the rinse solution therein, effecting a further dilution thereof and a reduction in the level of contamination. The quantity of fresh water admitted results in a rise in the level of liquid in tank 58, which in turn overflows the weir 112 and causes a successive counterflow of treating solution through tanks 56 and 54 in a direction of increasing contamination level, effecting a dilution and corresponding reduction in the contamination of these two rinse solutions, respectively.

It is also contemplated that each of the tanks 54, 56 and 58 can be equipped with suitable agitation means such as a propellertype agitator 132 shown in FIG. 3 to assure greater uniformity in composition of the rinse solutions therein and to avoid any stratification during operation.

In operation, and in accordance with the apparatus aspects of the present invention, a typical operating cycle at the plural rinse stations 6 and 8 of the apparatus schematically shown in FIG. 1 commences with a work carrier, such as a treating barrel, being transferred to a position above the apparatus as shown in FIGS. 3–5, whereupon it is lowered in supported relationship in the saddles 36. Upon attaining the fully lowered position as shown in FIGS. 3–5, which is signalled by a tripping of a down-position limit switch embodied in the conveying (not shown), an appropriate down dwell timer in the central control circuit is energized, which commences to time a predetermined treatment period. In the specific process illustrated in FIG. 1 of the drawings, the plural rinse treatment at stations 6 and 8 may comprise a 210 second dwell period corresponding to a processing rate of 15 barrels an hour with a 30 second allowance for transfer of the carrier to and from the rinse stations. The down dwell period is subdivided into three rinse periods with allowance for a drain period at the completion of each rinsing step. Each 70 second rinse cycle in turn is subdivided, for example, to include a 10 second period during which the rinse solution is directed into the barrel opening with the barrel stationary, a 30 second period during which the barrel is oscillated through three cycles to rinse the exterior of the barrel and flush the interior thereof, a 10 second spray rinse with the barrel stationary, and finally, a 20 second drain period while the barrel is oscillated.

In accordance with the foregoing operating sequence, upon energization of the down dwell timer, pump assembly 82 and solenoid valve 84 are actuated, causing rinse solution to pass upwardly through the supply conduit 78 into the nozzle header 74 for discharge from the nozzle or spray head 76 against the workpieces within the treating barrel as well as the exterior surfaces of the lower portion of the work carrier. At the same time, drive motor 50 is energized so as to position the opening 26 of the barrel in alignment with the discharge end of the nozzle. After the timing out of 10 seconds, the motor 50 is energized causing the barrel 21 to undergo three complete oscillations during the continued discharge of rinse solution, whereafter the motor 50 is deenergized with the opening of the barrel positioned to receive the rinse solutions discharged from the nozzles. The barrel remains stationary for an additional 10 second rinse period, upon the expiration of which the solenoid valve 84 closes and the pump 82 is deenergized, halting further solution flow through the supply conduit. The reversible motor 50 is energized to cause the treating barrel to undergo two complete oscillating cycles during the final 20 second drain period and the barrel is stopped with its opening 26 in alignment with the nozzles to receive the next treating solution.

During the initiation of the first rinsing step, the control circuit effects an energization of solenoid valve 104 (FIG. 4) causing the double-acting cylinder 98 to position the flexible spout above the deflector baffle 96 adjacent to tank 54, whereby the solution collected and drained from the testing chamber is returned to the tank. The cylinder 98 remains in this position for 20 seconds after pump assembly 82 and solenoid valve 84 are closed and during the oscillating cycle of the barrel to collect and return any residual water entrapped within the workpieces to the receptacle 54.

After the barrel has returned to the position as shown in FIG. 3, pump assembly 86 and solenoid valve 88 are actuated causing a second rinse solution to be pumped from tank 56 to the nozzle header for discharge against the workpieces. At the same time, solenoid valve 104 (FIG. 4) is actuated, enabling the piston and its rod 100 to return to an intermediate position in which the flexible spout 94 is positioned directly above the open end of tank 56. Accordingly, the second rinse solution passes in contacting relationship with the workpieces and is recovered and returned to its receptacle in the same manner as previously described in connection with the first rinse solution. At the completion of a prescribed time period, pump assembly 86 and the solenoid valve 88 are again deactivated and the barrel drive mechanism is actuated to cause an oscillation thereof to assure optimum drainage. Thereafter, the pump assembly 90 and the solenoid valve 92 are actuated to initiate the third and last rinsing step. At the initiation of the third rinse step, solenoid valve 104 (FIG. 4) is again actuated causing the rod 100 to retract the flexible spout 94 to a position of discharge above the tank 58 containing the third and least contaminated rinse solution, which is collected after discharge against the workpieces and returned to its respective tank. The discharge of the third and final rinse solution continues in the same manner as previously described, whereafter pump assembly 90 and solenoid valve 92 are deactivated and the barrel drive mechanism is again actuated to cause the treating barrel to undergo its oscillating cycle to assure substantially complete drainage of the workpieces therein. The foregoing plural rinse treatment is completed coincident with the timing out of the down dwell timer in the main machine control circuit, whereafter the automatic conveying apparatus withdraws the work carrier 14 from the treating station for transfer to the next adjoining treating station. The vacated plural rinsing apparatus is now in condition for receiving a new load of workpieces to be rinsed.

During the rinsing cycle, as well as the during time periods between rinsing cycles, the degree of contamination is continuously monitored by the conductivity sensing device 130, which through its control circuitry intermittently energizes the fresh water flow control solenoid valve 128, which admits fresh water into tank 58 in admixture with the treating solution therein so as to maintain a level of contamination below a preselected maximum value. The introduction of fresh water into tank 58 causes an overflow into the weir 112, which causes a counterflow of liquid through the three tanks at a rate substantially equal to the rate of fresh water make-up added to tank 58, less any losses due to evaporation and carry-out on the workpieces.

The advantages of the present invention are further illustrated with respect to the rinsing of small workpieces carried in treating barrels in a high cyanide zinc treatment process. Typically, the workpieces and treating barrel cause a dragout of about 1.5 gallons of solution which may typically contain about 16 ounces of sodium cyanide per gallon. Accordingly, each load contains 24 ounces of cyanide which should be rinsed from the workpieces and transfer equipment. Assuming each reservoir to contain about 30 gallons of rinse solution, a production rate of about 16 barrels per hour and a continuous flow of fresh make-up water of about one gallon per minute to the reservoir containing the third rinse solution, a dynamic equilibrium is attained whereby the first rinse solution will contain about 6 ounces per gallon of sodium cyanide, the second solution will contain about 0.22 ounce per gallon of sodium cyanide and the third and final rinse will contain about 0.007 ounce per gallon of sodium cyanide. It will be appreciated that variations in the level of contamination of the rinse solutions will occur as a result of changes in throughput, the types and quantities of workpieces in each treating barrel and the rate at which fresh make-up water is added to the reservoir containing the third rinse solution. By controlling the quantity of fresh make-up water added to the rinse system, the level of contamination of each of the rinse solutions can be controlled within the desired ranges. The high purity of the third and last rinse renders the part substantially clean for transfer into the next treating station, while the efficiency in the bulk rinsing provided results in a substantial decrease in volume of rinse water discharged from the first rinse solution containing the highest degree of contamination, thereby resulting in a substantially lower hydraulic load on the waste disposal treating system which may include evaporation concentraters as well as reagents for neutralizing and/or extracting the toxic contaminating materials before discharging to waste or recycling for reuse in the process.

Figure 6:
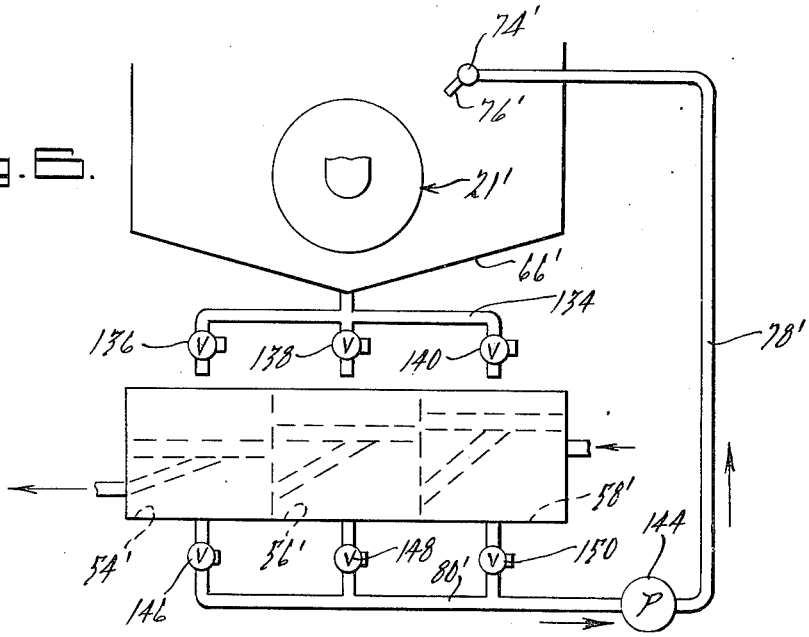
FIG. 6 is a schematic end elevational view illustrating an alternative satisfactory embodiment of the present invention.

An alternative satisfactory embodiment of the apparatus previously described is schematically shown in FIG. 6, in which like parts are designated by the same numeral with a prime affixed thereto. As shown, a treating barrel 21' is positioned within the collection chamber adjacent to the header 74' incorporating a plurality of nozzles 76' therein. The base 66' of the collection chamber is formed with a drain outlet connected to a drain header 134 which is provided with three separate branch lines, each incorporating a remotely actuatable solenoid valve 136, 138 and 140, respectively. The solenoid valves are energized in timed sequence to effect a return of recovered solution to the respective reservoir in a manner similar to the actuation of the double-acting cylinder 98 for positioning the flexible spout 94 of the embodiment shown in FIGS. 3–5.

In lieu of employing an individual pump assembly for each individual reservoir 54', 56' and 58', the embodiment of FIG. 6 utilizes a pump assembly 144 having its inlet side connected to a header 80' and its outlet side to a supply conduit 78' connected to the nozzle header 74'. The header 80' is connected to three individual supply conduits which are connected to each of the reservoirs and the supply conduits are provided with remotely actuatable solenoid valves 146, 148 and 150, respectively. Solenoid valves 146, 148 and 150 are adapted to be energized in timed sequence in a manner similar to the pump and valve assemblies 82, 84; 86, 88; and 90, 92, as previously described in connection with the embodiment of FIGS. 3–5.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. In an apparatus for performing a counterflow liquid treatment of workpieces, the improvement comprising a framework for supporting workpieces at a stationary position at a treating station, nozzle means for applying a liquid to the surfaces of workpieces when disposed at the treating station, plural reservoirs including a first reservoir containing a first liquid and a second reservoir containing a second liquid, supply means for sequentially supplying said first liquid and thereafter said second liquid to said nozzle means for a prescribed time period, collecting means for recovering the liquid discharged from said nozzle means, drain means in said collecting means for returning the recovered said first liquid to said first reservoir and the recovered said second liquid to said reservoir, respectively; means for sequentially positioning said drain means in communication with said first reservoir and said second reservoir in coordinated relationship with the operation of said supply means, inlet means for introducing a selected quantity of fresh make-up liquid to said second reservoir, transfer means for transferring a portion of said second liquid to said first reservoir and in admixture with said first liquid therein, and outlet means in said first reservoir for discharging a portion of said first liquid from said first reservoir.

2. The apparatus as defined in claim 1, further including coacting means on said framework for supporting a work carrier and its workpieces in aligned disposition relative to said nozzle means.

3. The apparatus as defined in claim 1, further including coacting means on said framework for receiving and supporting at said stationary position a work carrier comprising a treating barrel containing the workpieces therein, and drive means for selectively oscillating said treating barrel at selected times during the treatment cycle.

4. The apparatus as defined in claim 3, wherein said treating barrel is formed with an opening therein and further including means for energizing said drive means for positioning said opening to receive liquid discharged from said nozzle means.

5. The apparatus as defined in claim 1, wherein said supply means includes individual pumping means selectively and sequentially energizable for pumping said first liquid and thereafter said second liquid under pressure to said nozzle means.

6. The apparatus as defined in claim 1, wherein said collecting means comprises a three-dimensional enclosure within which the workpieces are disposed, said enclosure formed with a bottom panel angularly inclined with respect to the horizontal to promote gravitational flow of liquid toward the lower portion thereof for return to the respective reservoir.

7. The apparatus as defined in claim 1, wherein said drain means includes a drain conduit having one end connected to said collecting means for receiving the recovered liquid therein and the opposite discharge end selectively positionable between a first position in communication with said first reservoir and a second position in communication with said second reservoir.

8. The apparatus as defined in claim 1, wherein said inlet means includes flow control means for supplying fresh make-up liquid at prescribed times and in controlled quantities to the reservoir connected to said inlet means.

9. The apparatus as defined in claim 1, further including flow control means in said inlet means for supplying fresh make-up liquid to said second reservoir, and sensing means for sensing the characteristics of said second liquid and operatable for energizing said flow control means when a predetermined characteristic of said second liquid is present.

10. The apparatus as defined in claim 9, wherein said sensing means senses the electrical conductivity of said second liquid.

11. The apparatus as defined in claim 10, wherein said first and second liquid comprises a water rinse solution and said fresh make-up liquid comprises fresh water and wherein said sensing means is presettable to energize said flow control means when the conductivity of said second liquid rises to a preselected level evidencing the level of contamination of said second liquid.

12. The apparatus as defined in claim 1, including a third reservoir containing a third liquid interposed between said first and said second reservoirs and said transfer means include means for transferring a portion of said first liquid to said third reservoir and a portion of said third liquid to said second reservoir in a countercurrent flow relative to the sequence of application of the several liquids to the workpieces.

13. The apparatus as defined in claim 1, wherein said first and said second reservoir are formed with an overflow weir positioned to maintain the level of said second liquid above the level of said first liquid, said transfer means comprising a conduit having its inlet end disposed in communication with the weir in said second reservoir and its outlet in communication with said first reservoir, and said outlet means comprising a conduit having its inlet end disposed in communication with the weir in said first reservoir for receiving and discharging said first liquid therethrough.

* * * * *